US008668529B2

(12) United States Patent
Park et al.

(10) Patent No.: US 8,668,529 B2
(45) Date of Patent: Mar. 11, 2014

(54) CONTACT TERMINAL

(75) Inventors: Je-Min Park, Gyeongsangbuk-do (KR); Sung-Jun Hwang, Gyeongsangbuk-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 60 days.

(21) Appl. No.: 13/405,582

(22) Filed: Feb. 27, 2012

(65) Prior Publication Data

US 2013/0035006 A1 Feb. 7, 2013

(30) Foreign Application Priority Data

Aug. 3, 2011 (KR) ..... 10-2011-0077321

(51) Int. Cl.
*H01R 13/24* (2006.01)

(52) U.S. Cl.
USPC ..... 439/700

(58) Field of Classification Search
USPC ..... 439/700, 824, 862
See application file for complete search history.

(56) References Cited

U.S. PATENT DOCUMENTS 4,012,094 A * 3/1977 VanRenssen et al. ..... 439/58
4,159,505 A * 6/1979 Carp et al. ..... 361/752
4,213,078 A * 7/1980 Ferrell et al. ..... 320/107
4,413,874 A * 11/1983 Williams ..... 439/626
4,471,339 A * 9/1984 Fukada et al. ..... 338/162
5,052,943 A * 10/1991 Davis ..... 439/357
5,151,643 A * 9/1992 Emmert et al. ..... 320/115
5,447,442 A * 9/1995 Swart ..... 439/77
5,655,913 A * 8/1997 Castaneda et al. ..... 439/66
5,664,973 A * 9/1997 Emmert et al. ..... 439/862
5,716,230 A * 2/1998 Marren et al. ..... 439/500
5,807,123 A * 9/1998 Spiegelaar et al. ..... 439/188
5,863,674 A * 1/1999 Yamanaka ..... 429/100
5,980,268 A * 11/1999 Mischenko et al. ..... 439/66
5,980,335 A * 11/1999 Barbieri et al. ..... 439/824
6,022,248 A * 2/2000 Wu et al. ..... 439/862
6,039,601 A * 3/2000 Kraiczyk et al. ..... 439/500
6,093,053 A * 7/2000 Horioka et al. ..... 439/444
6,162,103 A * 12/2000 Ono ..... 439/824
6,227,872 B1 * 5/2001 Stephenson et al. ..... 439/76.1
6,280,258 B1 * 8/2001 Frohlund ..... 439/700
6,290,524 B1 * 9/2001 Simmel ..... 439/289
6,626,708 B2 * 9/2003 Phillips ..... 439/700
6,783,370 B2 * 8/2004 Miyamoto et al. ..... 439/66
6,945,800 B2 * 9/2005 Weight et al. ..... 439/136
7,270,550 B1 * 9/2007 Peng ..... 439/66
7,322,834 B2 * 1/2008 Hu et al. ..... 439/83
7,361,064 B2 * 4/2008 Chien et al. ..... 439/824
7,381,086 B1 * 6/2008 Gilmore et al. ..... 439/500
7,575,439 B2 * 8/2009 Chen et al. ..... 439/66
7,607,952 B2 * 10/2009 Tai ..... 439/700
7,662,000 B2 * 2/2010 Hou et al. ..... 439/824
8,111,867 B2 * 2/2012 Wu ..... 381/394
8,157,597 B2 * 4/2012 Chang ..... 439/660
8,414,312 B2 * 4/2013 Hung et al. ..... 439/108

* cited by examiner

*Primary Examiner* — Neil Abrams
(74) *Attorney, Agent, or Firm* — Cha & Reiter, LLC

(57) ABSTRACT

A contact terminal includes: a contact pin; and a plate spring configured to support the contact pin, wherein a portion of the plate spring is connected to a circuit board, wherein the contact pin can be connected to a counterpart while being supported by the plate spring, thus ensuring a stable connection structure.

19 Claims, 3 Drawing Sheets

CONTACT TERMINAL

CLAIM OF PRIORITY

This application claims the priority under 35 U.S.C. §119 (a) of an application entitled "Contact Terminal" filed in the Korean Intellectual Property Office on Aug. 3, 2011 and assigned Serial No. 10-2011-0077321, the contents of which are hereby incorporated by reference.

BACKGROUND OF THE INVENTION

1. Field of the Invention

The present invention relates to an electronic component, and more particularly to a contact terminal which provides a connection between two different parts such as a battery pack of a portable electronic device and various cables.

2. Description of the Related Art

In general, portable terminals house detachable battery packs and devices which require electrical connections between two different components such as a communication cable and a memory card socket. A docking cradle for a portable terminal further include various types of contact terminals.

For example, a portable terminal having a detachable battery pack includes a connection piece fixed into the battery pack, and a contact terminal with a plate spring called a C-clip which is disposed in a body of the portable terminal. When the battery pack is coupled to the body of the portable terminal, the connection piece of the battery pack pushes the contact terminal of the terminal body by a degree to maintain a stable connection state. A known contact terminal uses a plate spring and is provided to a connection structure of an above-mentioned battery pack or a connector of a communication cable.

Meanwhile, a portable terminal having a near field communication (NFC) function is becoming popular where various cards such as a traffic card, a user authentication security card, and a credit card are approved or authenticated through near field communication (NFC). To this end, a portable terminal utilizes a separate antenna for performing the NFC function which may be installed in a battery cover. Moreover, an antenna or a coil for wireless charging is installed in the battery cover, in which case a contact terminal needs to be installed to connect the antenna or coil to a circuit installed within the terminal body.

FIGS. 1 and 2 illustrate a conventional contact terminal 30, which is manufactured to have an 'S'-like shape by bending a metallic plate, and it has a pair of protruding contact portions 33*a* and 33*b* at upper and lower ends thereof. When the contact terminal 30 is installed within a housing 11 of the portable terminal, one of the contact portions 33*a* and 33*b* contacts a circuit board 13 installed within the housing 11, and the other contact a battery pack contacts a connection piece 23. Although FIG. 2 does not illustrate a deformed shape of the contact terminal 30, the contact terminal 30 is substantially compressed when the contact portions 33*a* and 33*b* contact surfaces of the circuit board 13 and the connection piece 23. As such, a resilient force caused by compression of the contact terminal 30 is intensively accumulated mainly at curved portions 35*a* and 35*b* of the contact terminal 30.

Such a conventional C-clip type contact terminal has a structure where a load is concentrated to curved portions, thus must be supported by a separate resilient body 37 such as silicon or urethane to secure durability. That is, the C-clip is supported by the resilient member 37 as a load continues to be applied to the C-clip but it may be permanently deformed when an excessive load is applied thereto. Also, as a predetermined area of the C-clip is exposed to external to provide a stable connection, an outer aesthetic appearance of the portable terminal is suffered. Further, since the C-clip is manufactured by bending a plate, a sharp portion may be formed at a side thereof, in which case a user may be injured or an external environment may be damaged.

FIGS. 3 and 4 illustrate a general pogo pin 40 and a structure where two different parts 13 and 23 are connected to each other via the pogo pin 40. A portion of a contact pin 43 is received within a tube 41 of the pogo pin 40, and the contact pin 43 linearly reciprocates in a direction where the contact pin 43 is inserted into or extracted from the tube 41. Then, a coil spring 45 is accommodated in the contact pin 43, and an end of the coil spring 45 protrudes toward one end of the contact pin 43 to be supported by the tube 41. The coil spring 45 provides a resilient force applied in a direction where the contact pin 43 is extracted from the tube 41.

The pogo pin 40 is installed in a portable terminal with one end of the tube 41 contacting the circuit board 13 of the portable terminal and an opposite end of the contact pin 43 protruding to the outside of the portable terminal Then, a separate C-clip 19 is disposed between the circuit board 13 and the tube 41 to stably connect the pogo pin 40 to the circuit board 13. When the pogo pin 40 is utilized as a contact terminal for connection of a battery pack, if the battery pack is coupled to a portable terminal, the contact piece 23 of the battery pack pushes an end of the contact pin 43 which in turn causes the contact pin 23 retreats into the tube 41. Then, a resilient force accumulated while the coil spring 45 is being compressed and stably maintains the contact pin 43 to be connected to the contact piece 23 and the tube 41 to be connected to the circuit board 13.

Although the pogo pin has a higher quality and provide a better outer appearance than that of a plate spring, the pogo pin cost more, thereby increasing the manufacturing costs of the portable terminal. Further, noise is generated by relative movement between components of the pogo pin itself which is a drawback and undesirable during operation.

SUMMARY OF THE INVENTION

Accordingly, the present invention has been made to solve the above-mentioned problems occurring in the prior art and provides additional advantages, by providing a contact terminal which is inexpensive and provides a better aesthetic appearance and durability.

Another aspect of the present invention provides a contact terminal whose exposure to the exterior is minimum, thus improving an outer appearance of a portable terminal or a docking cradle.

A further aspect of the present invention provides a contact terminal which cannot be permanently deformed while maintaining a stable connection state.

In accordance with an aspect of the present invention, a contact terminal includes: a contact pin; and a plate spring for supporting the contact pin, wherein a portion of the plate spring is connected to a circuit board.

In accordance with an aspect of the present invention, a terminal comprising: a housing; and a contact terminal having a plate spring providing a resilient force and a contact pin supported by the plate spring, wherein the plate spring is mounted within a body of the housing, and a portion of the contact pin protrudes to exterior of the body housing, such that a portion of the plate spring is connected to a circuit board and the portion of the contact pin electrically connects to a battery pack or a battery cover.

According to the above-mentioned contact terminal, the contact pin can be connected to a counterpart while being supported by the plate spring, thereby ensuring a stable connection structure. Then, only one end of the contact pin is exposed to the outside of a portable terminal or a docking cradle, thus improving an appearance of a product. In addition, since a load applied to the plate spring can be adjusted by adjusting a length of the contact pin, in particular, a length of a portion of the contact pin exposed to the outside of the product, the durability of the product can be easily guaranteed without supporting the plate spring with a separate resilient body. Further, the product can be manufactured at a lower cost which in turn contributes to a reduction of manufacturing costs.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE PRESENT INVENTION

Hereinafter, exemplary embodiments of the present invention will be described with reference to the accompanying drawings. For the purposes of clarity and simplicity, a detailed description of known functions and configurations incorporated herein will be omitted as it may make the subject matter of the present invention unclear.

Figure 1:
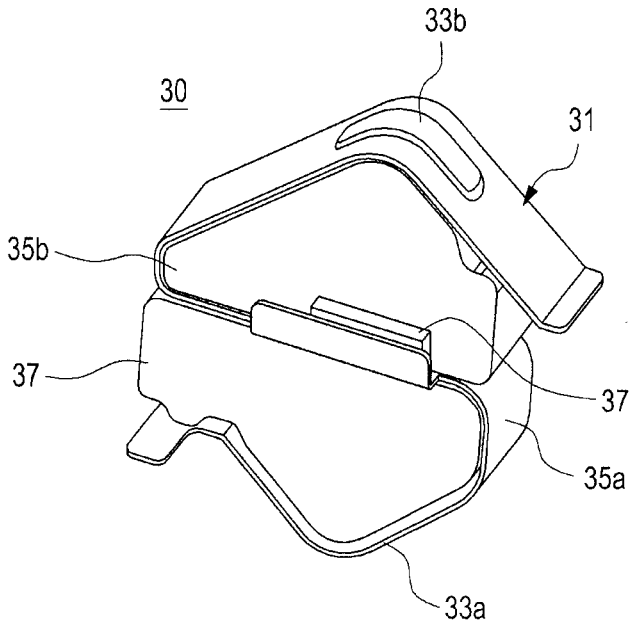
FIG.1 (PRIOR ART)
FIG. 1 is a perspective view illustrating a conventional contact terminal.
Figure 2:
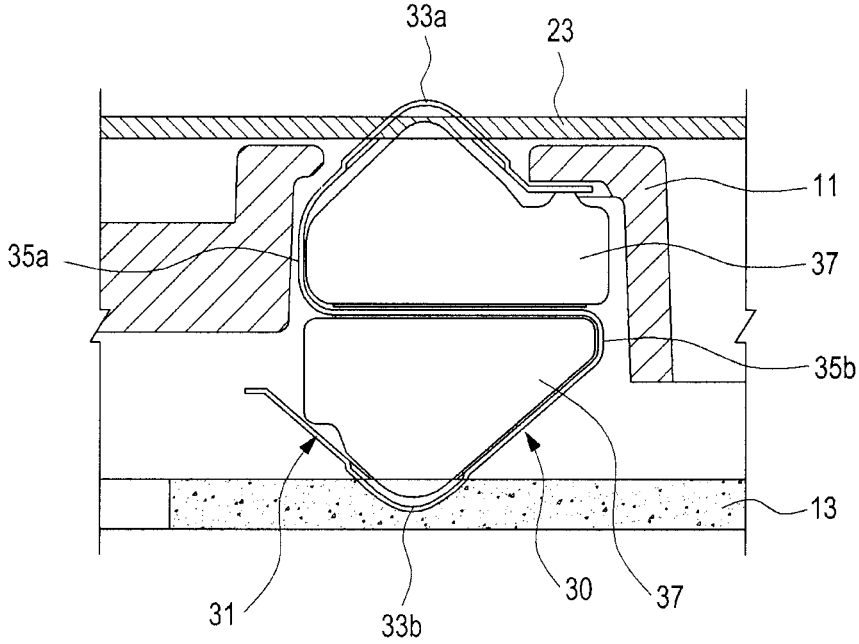
FIG.2 (PRIOR ART)
FIG. 2 is a sectional view illustrating a state where the contact terminal of FIG. 1 is installed in a portable terminal.
Figure 3:
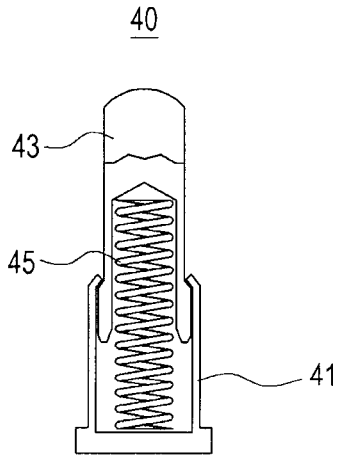
FIG.3 (PRIOR ART)
FIG. 3 is a view illustrating another conventional contact terminal which is partially cutaway.
Figure 4:
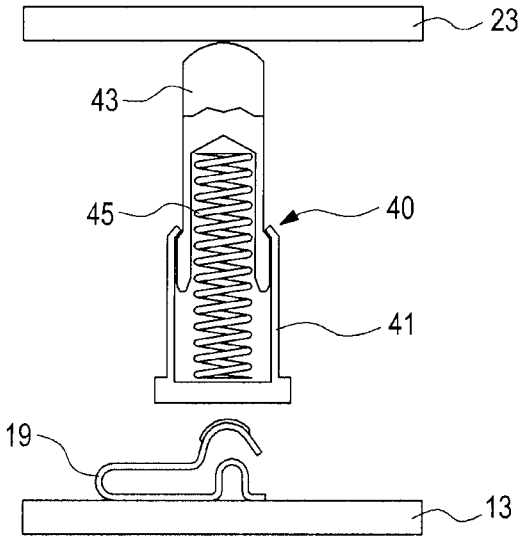
FIG.4 (PRIOR ART)
FIG. 4 is a view illustrating a state where the contact terminal of FIG. 3 electrically connects two different parts.
Figure 5:
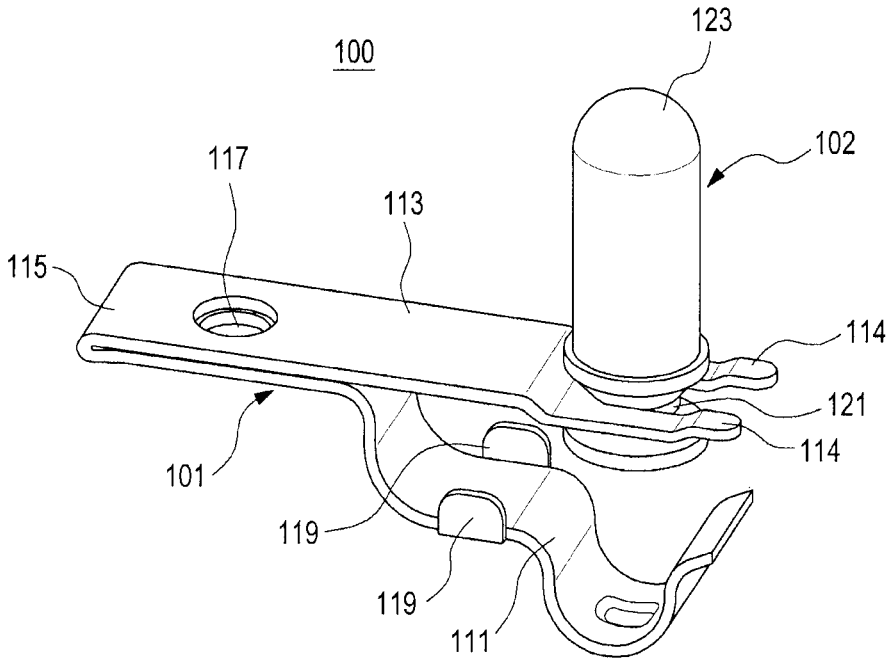
FIG. 5 is a perspective view illustrating a contact terminal according to an embodiment of the present invention.
Figure 6:
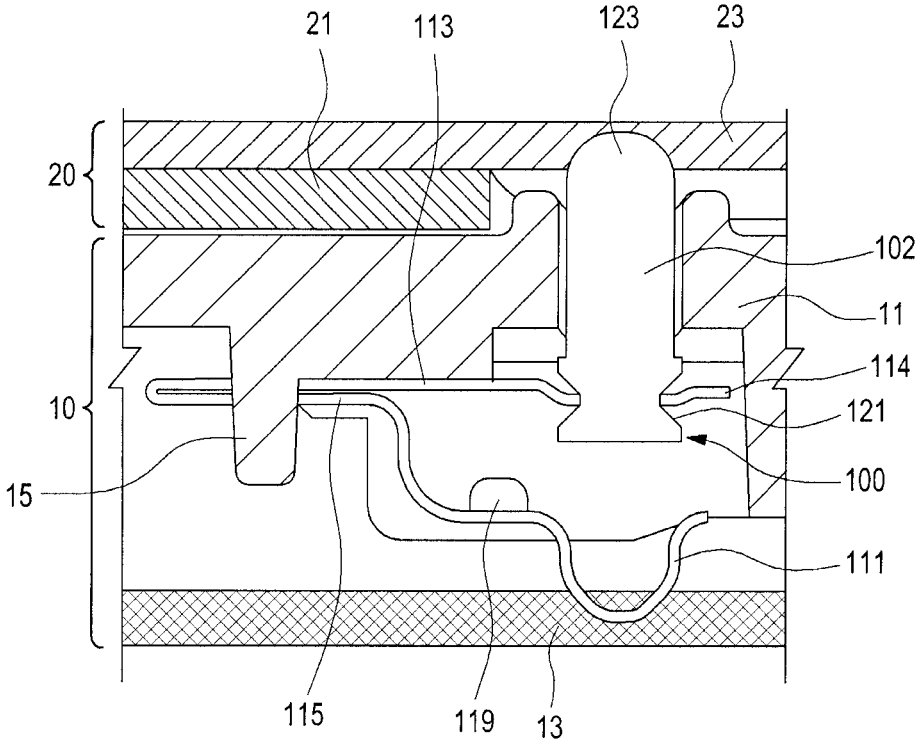
FIG. 6 is a sectional view illustrating a state where the contact terminal of FIG. 5 is installed in a portable terminal.

Referring to FIGS. 5 and 6, a contact terminal 100 according to an embodiment of the present invention includes a plate spring 101 and a contact pin 102. The plate spring 101 is mounted within a body housing 11 of a product 10 such as a portable terminal or a docking cradle, and a portion of the contact pin 102 protrudes to the outside of the body housing 11 while the contact pin 102 is being supported by the plate spring 101. A counterpart 20 of, for example, a battery pack or a battery cover, is coupled to the body housing 11, and a connection piece 23 is installed within a housing 21 (hereinafter, referred to as 'a second housing') of the counterpart 20.

When the second housing 21 is coupled to the body housing 11, the contact piece 23 is situated at a point corresponding to the contact piece 102. The contact pin 102 protrudes to the outside of the body housing 11, and an end of the contact pin 102 contacts the connection pin 23. Then, since the plate spring 101 provides a resilient force by which the contact pin 102 is attached to the connection piece 23, the contact terminal 100 and the connection pin 23 can maintain a stable connection.

The plate spring 101 has a first support 111 and a second support 113. The first support 111 is curved and is connected to a circuit board 13 installed within the body housing 11. The second support 113 extends linearly from one end of the first support 111. Here, the second support 113 may extend to be curved. However, it is noted that when the second housing 21 is coupled to the body housing 11, a resilient force generated by the plate spring is provided such that the contact pin 102 protrudes to the outside of the body housing 11 to be stably connected to the connection piece 23.

It is also noted that the first support 111 of the plate spring 101 contacts the circuit board 13 and the contact pin 102 contacts the connection piece 23 such that the first and second supports 111 and 113 are deformed to a degree in a direction where face each other, but FIG. 6 illustrates a state where the first and second supports 111 and 113 are not deformed yet although the first support 111 of the plate spring 101 contacts the circuit board 13 and the contact pin 102 contacts the connection piece 23.

In a detailed description of the first and second supports 111 and 113, the first and second supports 111 and 113 preferably face each other, in which case the first support 111 preferably extends in a direction far away from the second support 113 at one end thereof, extends in parallel to the second support 113 at a middle portion thereof, and has a U-like shape to have a protrusion contacting the circuit board 13 at an opposite end thereof.

In order to fix the contact terminal 100, more specifically, the plate spring 101 within the body housing 11, at least a portion of one end of the first support 111 preferably extends to face the second support 113 in parallel to the second support 113, forming a folding portion 115. Through-holes 117 are formed in the folding portion 115, and the contact terminal 100 is fixed within the body housing 11 using the through-hole 117. Then, the folding portion 115 is preferably formed such that a portion of the first support 111 parallel to the second support 113 is adjacent to the second support 113 at the one end portion of the first support 111.

In order to fix the contact terminal 100 within the body housing 11, a fixing boss 15 may be formed on an inner surface of the body housing 11. The body housing 11 is manufactured through injection molding, and the plate spring 101 is coupled within the body housing 11 such that the fixing boss 15 passes through the through-hole 117. By doing this, the contact terminal 100 is installed within the body housing 11. Then, one end of the fixing boss 15 is fused to fix the contact terminal 100, in more detail, the plate spring 111 so as to prevent the plate spring 111 from being moved.

Meanwhile, since the plate spring 101, in particular, the first support 111 continues to accumulate a resilient force while the contact terminal 100 is in contact with the circuit board 13, a pair of reinforcing portions 119 may be formed to prevent permanent deformation. The reinforcing portions 119 extend from opposite sides of a middle portion of the first support 111 to face each other. Accordingly, the reinforcing portions 119 reinforce a resilient force of the plate spring 101 and serves to prevent a permanent deformation, thus enhancing a durability of the contact terminal 100.

A pair of fastening pieces 114 are formed at one end of the second support 113 and in parallel to each other. The fastening pieces 114 are engaged with the contact pin 102 to fix the contact pin 102.

The contact pin 102 has a engaging recess 121 at one end thereof. The engaging recess 121 is recessed along an outer periphery of one end of the contact pin 102. An opposite end 123 of the contact pin 102 protrudes to the outside of the body housing 11, and is preferably curved. As the opposite end 123 of the contact pin 102 is curved, the contact pin 102 stably contacts the connection piece 23 when the second housing 21 is coupled to the body housing 11.

The contact pin 102 is interference-fitted between the fastening pieces 114, in which case the coupling recess 121 is fitted with the fastening pieces 114. As a result, the contact pin 102 is fixed to the plate spring 101.

It has already been stated that when the contact terminal 100 is installed within the body housing 11, the second support 113 provides a resilient force applied in a direction where the contact pin 102 protrudes to the outside of the body housing 11. In this case, the second support 113 is interfered with an inner peripheral surface of the body housing 11, remaining parallel to the circuit board 13 while maintaining a linear form.

Meanwhile, when the second housing 21 is coupled to the body housing 11, a curvature by which the second support 113 is deformed is determined depending on a length by which the contact pin 102 protrudes to the outside of the body housing 11. A curvature formed after the second support 113 is deformed determines a load applied to the second support 113, and is an important factor which influences a durability of the second support 113. Thus, in order to improve the durability of the second support 113, it is desirable that the length by which the contact pin 102 protrudes to the outside of the body housing 11 is decided taking the curvature of the deformed second support 113 and the load applied to the deformed second support. That is, since a load applied to the plate spring can be adjusted by adjusting a length of the contact pin, in particular, a length of a portion of the contact pin exposed to the outside of the product, the durability of the product can be easily guaranteed without supporting the plate spring with a separate resilient body and the product can be manufactured at a lower cost, contributing to the reduction of manufacturing costs.

Accordingly, since the contact terminal 100 has a pin-like form where an end 123 thereof protruding to the outside of the body housing 11 is curved, the hole formed in the body housing 11 and through which the contact pin 102 protrudes can be made smaller, making an appearance of the portable terminal appealing. Also, since a portion supporting the contact pin 102, i.e. the second support 113 has a linear form, there is no possibility of permanently deforming the plate spring 101 when compared with a conventional C-clip type bent contact terminal. Moreover, although a conventional contact terminal using a pogo pin has a higher quality than a C-clip type contact terminal, an outer appearance of a product is poorer, a durability is issue due to a high chance of being permanently deformed, and lastly its manufacturing cost is higher. As compared with a pogo pin, the contact terminal 100 according to the present invention can be manufactured at lower costs.

While the invention has been shown and described with reference to a certain embodiment thereof, it will be understood by those skilled in the art that various changes in form and details may be made therein without departing from the spirit and scope of the invention as defined by the appended claims.

What is claimed is:

1. A contact terminal comprising:

a contact pin having a curved portion at its one end; and a plate spring having a first support and a second support for supporting the contact pin, the first support and the second support having a first end and a second end extended therefrom, respectively, and wherein the first support and the second support form a closed loop configuration at the first end and a detached cantilevered configuration at the second end, and wherein a portion of the plate spring is connected to a circuit board, and wherein the plate spring provides a resilient force as the first support is in contact with the circuit board and the contact pin supported by the second support electrically contacts an exterior unit.

2. The contact terminal as claimed in claim 1, further comprising:

an engaging recess formed in the contact pin; and a pair of fastening pieces formed in the plate spring, wherein the fastening pieces are engaged with the engaging recess to fix the contact pin to the plate spring.

3. The contact terminal as claimed in claim 2, wherein the engaging recess is formed on an outer peripheral surface of one end of the contact pin.

4. The contact terminal as claimed in claim 1, wherein the first support having a curved shape and the second support linearly extending from one end of the first support.

5. The contact terminal as claimed in claim 4, further comprising:

a engaging recess formed in the contact pin; and a pair of fastening pieces extending from one end of the second support, wherein the contact pin is situated between the fastening pieces, and the fastening pieces are engaged with the engaging recess to fix the contact pin to the plate spring.

6. The contact terminal as claimed in claim 5, wherein the engaging recess is formed on an outer peripheral surface of one end of the contact pin.

7. The contact terminal as claimed in claim 4, wherein the first support is connected to the circuit board and the second support is disposed in parallel to the circuit board.

8. The contact terminal as claimed in claim 4, further comprising:

a folding portion is formed a folding portion of the plate spring such as one end of the first support extends in parallel to the second support to face each other; and coupling holes formed in the folding portion to pass through the folding portion.

9. The contact terminal as claimed in claim 4, further comprising a pair of reinforcing portions extending from opposite sides of the first support to face each other.

10. The contact terminal as claimed in claim 1, wherein one end of the contact pin is engaged with the plate spring, and wherein an opposite end the contact pin is curved.

11. The contact terminal as claimed in claim 1, the contact pin and the plate spring are housed within a portable terminal.

12. The contact terminal as claimed in claim 1, the contact pin and the plate spring are housed within a docking cradle.

13. The contact terminal as claimed in claim 1, wherein a load applied to the plate spring is selectively adjusted by adjusting a length of the contact pin.

14. A terminal comprising:

a housing; and a contact terminal having a plate spring providing a resilient force and a contact pin supported by the plate spring, the plate spring having a first support and a second support for supporting the contact pin, the first support and the second support having a first end and a second end extended therefrom, respectively, and wherein the first support and the second support form a closed loop configuration at the first end and a detached cantilevered configuration at the second end, and wherein the plate spring is mounted within a body of the housing, and a portion of the contact pin protrudes to exterior of the body housing, such that a portion of the plate spring is connected to a circuit board and the portion of the contact pin electrically connects to a battery pack or a battery cover.

15. The terminal as claimed in claim 14, further comprising:

an engaging recess formed in the contact pin; and a pair of fastening pieces formed in the plate spring, wherein the fastening pieces are engaged with the engaging recess to fix the contact pin to the plate spring.

16. The terminal as claimed in claim 14, wherein the plate spring has a first support having a curved shape and a second support linearly extending from one end of the first support.

17. The terminal as claimed in claim 16, further comprising:

a folding portion extending from the body housing; and coupling holes formed in the first and the second supports to engage with the folding portion.

18. The terminal as claimed in claim 16, further comprising a pair of reinforcing portions extending from opposite sides of the first support to prevent a deformation of the contact terminal.

19. The terminal as claimed in claim 14, wherein a load applied to the plate spring is selectively adjusted by adjusting a length of the contact pin.

* * * * *

UNITED STATES PATENT AND TRADEMARK OFFICE

CERTIFICATE OF CORRECTION

PATENT NO. : 8,668,529 B2
APPLICATION NO. : 13/405582
DATED : March 11, 2014
INVENTOR(S) : Je-Min Park et al.

It is certified that error appears in the above-identified patent and that said Letters Patent is hereby corrected as shown below:

In the Claims:

Column 6, Claim 5, Line 20 should read as follows:
--…an engaging recess formed…--

Signed and Sealed this
Twenty-seventh Day of May, 2014

Michelle K. Lee

Michelle K. Lee
*Deputy Director of the United States Patent and Trademark Office*